US005367289A

United States Patent [19]

Baro et al.

[11] Patent Number: 5,367,289

[45] Date of Patent: Nov. 22, 1994

[54] ALARM TAG FOR AN ELECTRONIC ARTICLE SURVEILLANCE SYSTEM

[75] Inventors: Anthony Baro, Boca Raton; Alan E. Willard; Doug Narlow, both of Coral Springs, all of Fla.

[73] Assignee: Sensormatic Electronics Corporation, Deerfield Beach, Fla.

[21] Appl. No.: 800,576

[22] Filed: Nov. 27, 1991

[51] Int. Cl.[5] ..... G08B 13/00; E05B 65/00

[52] U.S. Cl. ..... 340/566; 70/57.1; 340/572

[58] Field of Search ..... 340/566, 572, 573, 660–661, 340/665, 825.54, 505, 506, 541–542; 310/328, 330–332; 70/57.1, DIG. 49; 367/140

[56] References Cited

U.S. PATENT DOCUMENTS

| | | | |
|---|---|---|---|
| 3,755,803 | 8/1973 | Cole et al. | 340/280 |
| 3,942,829 | 3/1976 | Humble et al. | 70/57.1 |
| 4,221,025 | 9/1980 | Martens et al. | 70/57.1 |
| 4,242,671 | 12/1980 | Plows | 340/572 |
| 4,558,307 | 12/1985 | Lienart van Lidt deJeude | 340/527 |
| 4,573,042 | 2/1986 | Boyd et al. | 340/539 |
| 4,598,275 | 7/1986 | Ross et al. | 340/573 |
| 4,675,656 | 6/1987 | Narcisse | 340/539 |
| 4,686,513 | 8/1987 | Farrar et al. | 340/572 |
| 4,745,398 | 5/1988 | Abel et al. | 340/500 |
| 4,758,824 | 7/1988 | Young | 340/566 |
| 4,812,811 | 3/1989 | Asbrink et al. | 340/571 |
| 4,883,271 | 11/1989 | French | 273/454 |
| 4,952,928 | 8/1990 | Carroll et al. | 340/825.54 |
| 5,012,224 | 4/1991 | Drucker | 340/551 |
| 5,019,801 | 5/1991 | Anderson, III | 340/522 |
| 5,031,287 | 7/1991 | Charlot, Jr. et al. | 70/57.1 X |
| 5,168,263 | 12/1992 | Drucker | 340/572 X |

*Primary Examiner*—John K. Peng
*Assistant Examiner*—Thomas J. Mullen, Jr.
*Attorney, Agent, or Firm*—Robin, Blecker Daley & Driscoll

[57] ABSTRACT

An electronic article surveillance tag which is responsive to forces applied to the tag's housing. The tag has a piezoelectric film which is attached to the tag housing in such a way that forces which are applied to the tag housing are mechanically coupled to the piezoelectric film. The piezoelectric film generates a voltage which is proportional to the forces mechanically coupled thereto. An alarm detecting means compares the voltage generated by the piezoelectric film with a predetermined reference voltage, and initiates an audible alarm when the voltage generated exceeds the predetermined reference voltage.

24 Claims, 3 Drawing Sheets

ALARM TAG FOR AN ELECTRONIC ARTICLE SURVEILLANCE SYSTEM

FIELD OF THE INVENTION

This invention relates to a tag for use in an electronic article surveillance (EAS) system, and, in particular, to a tag which can detect attempts to forcibly detach the tag from an article being monitored and also can detect attempts to tamper with the tag.

BACKGROUND OF THE INVENTION

There have been developed many types of tags for use in electronic article surveillance (EAS) systems, where the tag is mechanically attachable to an article to be monitored. To prevent unauthorized removal of the tag, various mechanical locking mechanisms have been employed to attach the tag to the article. A removal tool (typically located at the checkout counter) is provided to disengage the locking mechanism, and therefore, permit authorized removal of the tag. However, it is known that unauthorized removal of the tag can occur by defeating the locking mechanism.

To discourage unauthorized removal of the tag, it is known from U.S. Pat. No. 5,031,287 to include a breakable ink cartridge in the tag. An attempt to forcibly remove the tag from the article causes the ink cartridge to break, and, as a result, the ink splashes on the attached article. This renders the article unsuitable for use (i.e., ruins clothing) and/or renders the article readily detectable, by visual observation.

The use of ink type tags often discourages unauthorized removal of the tag. However, this approach is disadvantageous in that when the ink cartridge is broken, both the tag and the attached article are destroyed. Further, it is also possible to defeat the locking mechanism without causing the ink cartridge to break.

U.S. Pat. No. 4,686,513 discloses an alternative method of discouraging unauthorized removal whereby the state of the locking mechanism is electrically detected and an audible alarm is initiated upon detection of a disengaged state of the locking mechanism. In this way, attention is drawn towards a tag which has its locking mechanism disengaged.

By way of example, a tag is known in which an attached retaining tack is inserted into a tack clip which has a mechanical locking mechanism for holding the retaining tack in place. The tack clip is provided with an electrical switch which is arranged to enable an alarm sounder when opened. The switch is closed when the retaining tack is inserted and is opened when the retaining tack is removed. Accordingly, when the locking mechanism is disengaged (i.e., the retaining tack is removed from the tack clip), the electrical switch is opened, thereby initiating the alarm sounder located within the tag.

The above described tag, which detects the insertion of the retaining tack, is disadvantageous in that it can be disabled without opening the electrical switch. As a result, the sounder is not initiated.

Another disadvantage of the known tags is that they are vulnerable to forcible tampering (i.e., forcibly violating the tag's housing). To detect forcible tampering, U.S. Pat. No. 4,686,513 describes a tag in which an electrical switch in the tag housing is responsive to crushing forces applied to the tag housing. The electric switch is arranged to initiate an alarm sounder. In this way, attempts to crush the tag or to use a crushing force to crack open the tag's housing are detected by the electrical switch which in turn initiates an alarm sounder.

The above described tag is not however effective in detecting other types of forcible tamperings, such as, for example, stretching, bending, shock and vibrations, all of which are capable of affecting the performance of the tag. Further, the electrical switch does not detect attempts to defeat the locking mechanism as described above.

It is therefore an object of the present invention to provide an improved tag for use in an EAS system.

It is a further object of the present invention to provide a tag for use in an EAS system which detects forces applied to the tag's housing.

It is yet a further object of the present invention to provide a tag for use in an EAS system which detects forcible tamperings.

It is a still further object of the present invention to provide a tag for use in an EAS system which detects forces applied to the tag which are of the type sufficient to accomplish an unauthorized removal of the tag from an article being monitored.

SUMMARY OF THE INVENTION

In accordance with the principles of the present invention, the above and other objectives are realized in a tag in which a piezoelectric means is attached to the tag housing in such a way that a force applied to the tag housing is mechanically coupled to the piezoelectric means. This causes a change in the piezoelectric means which is detected by an alarm detection means also included in the tag housing and adapted to initiate an audible signal.

In the disclosed embodiment, the change in the piezoelectric means causes the piezoelectric means to generate a voltage which is proportional to the mechanically coupled force. The alarm detection means has a voltage comparing means for comparing the voltage generated by the piezoelectric means with a predetermined reference voltage. When the voltage generated exceeds the predetermined reference voltage the alarm is initiated.

In a further aspect of the invention, the tag further comprises a locking means for removably attaching the tag housing means to the article to be monitored. The locking means is attached to the housing means in such a way that a force applied to the locking means is mechanically coupled to the piezoelectric means. In this way, when sufficient force is applied to either the tag housing means or the locking means, the force is mechanically coupled to the piezoelectric means, and an alarm is initiated.

Also described is an electronic article surveillance system using the above described tag which is adapted to further include a detectable label within its housing means. The system further comprises transmitting means for transmitting a signal into an interrogation zone. When placed within the interrogation zone, the detectable label in the tag causes a detectable signal to be generated which is received and detected by receiving means, which in turn, generates an alarm.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
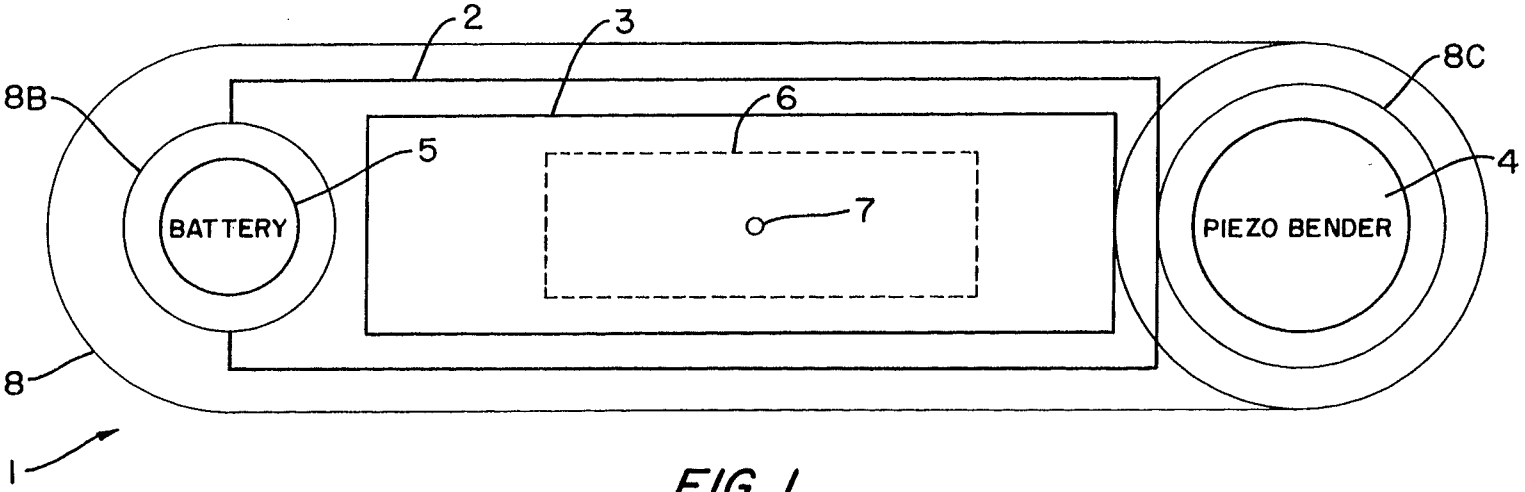
FIGS. 1 and 2 show a tag for use in an electronic article surveillance system in accordance with the principles of the present invention.
Figure 2:
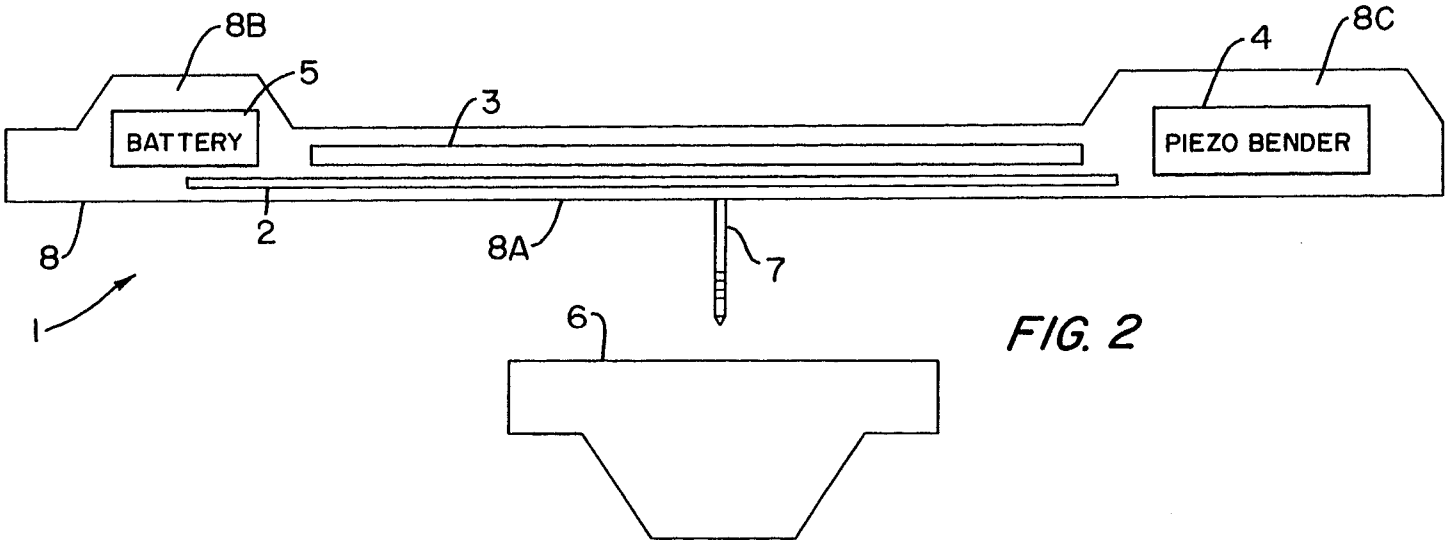

FIG. 1 and FIG. 2 are top and side views, respectively, of a tag 1 for use in an EAS system (not shown) in accordance with the principles of the present invention. As illustrated, the tag 1 comprises a tag housing 8 having a flat bottom wall 8A, a battery cavity 8B, and a piezo bender cavity 8C. Adhered to inner surface of the flat bottom wall 8A of the tag housing 8 is a piezoelectric film 2. The film 2 is electrically connected to a printed circuit board (PCB) 3 which is mounted in nearly parallel relation to the film. A battery 5 (e.g., 1.5 V battery) and a piezo bender 4 are electrically connected to the PCB 3 and are mounted within the battery cavity 8B and the piezo bender cavity 8C, respectively.

A retaining tack 7 protrudes perpendicularly from the flat bottom wall 8A of the tag housing 8. A tack clip 6 receives the retaining tack 7 and comprises a locking mechanism (not shown) for mechanically locking the tack clip 6 to the retaining tack 7. Accordingly, by placing the retaining tack 7 through an article to be monitored, and locking the retaining tack 7 in the tack clip 6, the tag 1 is mechanically attached to the article. Typical locking mechanisms for the clip 6 might be those described in U.S. Pat. Nos. 3,942,829 and 4,221,025.

The piezoelectric film 2 is adhered to the inner surface of the flat bottom wall 8A of the tag housing 8. External forces, such as, for example, bending, stretching, shock, vibration and compression forces, directed to the tag 1 are then mechanically coupled to the piezoelectric film 2. The piezoelectric film 2 is responsive to these mechanically coupled forces and provides a voltage signal output V which is related thereto.

In more detail, the piezoelectric film 2 generates a voltage V when stressed. The voltage V generated by the piezoelectric film 2 for a given stress can be expressed as:

$$V=g\cdot X\cdot t \qquad \text{(equation 1)}$$

where:
X=stress=F/A
g=piezo constant
t=thickness of film

By way of example, if a force of 20N is mechanically coupled from the tag 1 to a circular area having a $4\times10^{-3}$ m radius on a 28 μm thick piezoelectric film 2, the voltage generated by the piezoelectric film 2 will equal:

$$V=g\cdot X\cdot t$$

where:
X=stress=F/A
F=20N≈4.5 Lbs.
$A=\pi\cdot(4\times10^{-3})^2$
$X\approx4\times10^{+5}\ Nm^{-2}$
g=piezo constant=$-0.339\ V\ m^{-1}/Nm^{-2}$
t=thickness of film=28 μm
therefore:

$$V=(-0.339\ V\,m^{-1}/Nm^{-2})\cdot(4\times10^{+5}\ Nm^{-2})\cdot(28\ \mu m)=-3.8\ V$$

Figure 3:
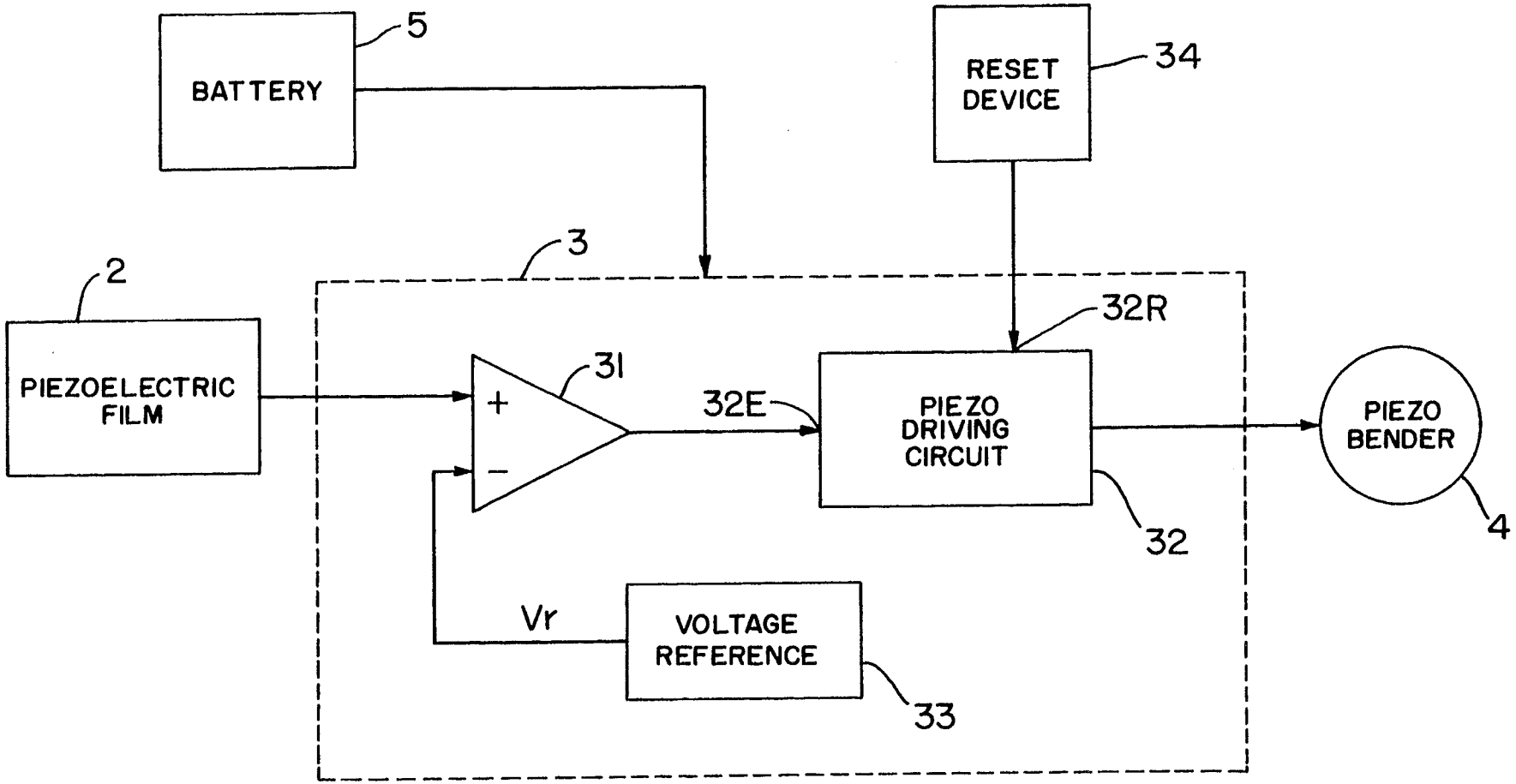
FIG. 3 shows a block diagram illustrating portions of the tag of FIGS. 1 and 2.

FIG. 3 is a functional block diagram of the tag 1 in accordance with the principles of the present invention. The battery 5 connects to the PCB 3 and provides power to a voltage comparator 31, a voltage reference generator 33 and a piezo driving circuit 32, all of which are located on the PCB 3. The output of the piezo driving circuit 32 is coupled to the piezo bender 4. The voltage comparator 31 compares the absolute value of the voltage V output from the piezoelectric film 2 with a predetermined reference voltage Vr formed by the voltage reference generator 33. When the absolute value exceeds the reference voltage Vr, the output of the voltage comparator 31 is set to an active logic level.

The output of the voltage comparator 31 is coupled to an enable input 32E of the piezo driving circuit 32. When the output provides an active logic level the piezo driving circuit 32 generates a drive signal which drives the piezo bender 4, thereby generating an audible alarm sound. After the active logic level is removed from the enable input 32E, the piezo driving circuit 32 continues to generate the driving signal until a reset signal is received at a reset input 32R of the piezo driving circuit 32.

A reset device 34 is coupled to a reset input 32R of the piezo driving circuit 32. Activation of the reset device 34 causes the piezo driving circuit 32 to stop generating the drive signal. In this way, the audible alarm sound is turned off. The reset device 34 is arranged (either electrically or mechanically) to prevent unauthorized persons from activating the device.

The reset device 34 can take on any number of forms. A particular configuration might comprise an inductor (coil) which is responsive to an external signal or field. The inductor coil can be coupled to a transistor switch which acts to inhibit the piezo bender. By applying an external field to the coil from a deactivation device, a voltage is induced in the coil which switches the transistor switch, causing the piezo bender to be inhibited.

As above-indicated, when a force mechanically coupled to the piezoelectric film 2 is sufficient to cause the piezoelectric film 2 to form a voltage V which exceeds the reference voltage Vr, the comparator 31 provides an active logic level to the enable input 32E of the piezo driving circuit 32. Responsive to the active logic level, the piezo driving circuit 32 generates a driving signal which causes the piezo bender 4 to generate an alarm sound. Thereafter, when the force is removed, thereby reducing the voltage V below the voltage Vr, the comparator 31 ceases to output the active level signal. However, the removal of this signal from the enable input 32E of the piezo driving circuit 32 does not stop the generation of the drive signal. The piezo driving circuit 32 continues to generate the driving signal until a reset signal is received at reset input 32R from reset device 34.

The sensitivity of tag 1 (i.e., the amount of force required to be applied to the tag 1 to initiate the audible alarm sounder) can be adjusted by changing the value of the reference voltage Vr. As the reference voltage Vr is increased, the sensitivity of the tag is decreased since a larger force is required to be mechanically coupled to the piezoelectric film 2 to cause the voltage V generated by film 2 to exceed the reference voltage Vr. Conversely, as the reference voltage Vr is reduced, the sensitivity of the tag 1 is increased, and therefore, an audible alarm will be initiated for smaller forces mechanically coupled to the piezoelectric film 2.

The sensitivity of the tag 1 is further affected by the degree of mechanical coupling between the forces applied to the outside of the tag housing 8 and the piezoelectric film 2. For a given force applied to the outside of the tag housing 8, as the degree of mechanical coupling between the applied force and the piezoelectric film 2 is increased, the magnitude of the force which is mechanically coupled to the piezoelectric film 2 is increased, and therefore, the voltage output V by the piezoelectric film 2 is increased. Accordingly, as the degree of mechanical coupling between forces applied to the outside of the tag housing 8 and the piezoelectric film 2 increases, the sensitivity of the tag 1 increases. Conversely, for a given force applied to the outside of the tag housing 8, as the degree of mechanical coupling is decreased, the magnitude of the force coupled to the piezoelectric film 2 decreases, and therefore, the voltage output V generated by the piezoelectric film 2 and the sensitivity of the tag 1, are reduced.

As can be appreciated, the degree of mechanical coupling of forces (i.e., bending, twisting and crushing) applied to the outside of the tag housing 8 and the piezoelectric film 2 generally increases as the rigidity of the tag housing 8 is decreased. Conversely, as the rigidity of the tag housing 8 is increased, the degree of the mechanical coupling between the forces applied to the outside of the tag housing 8 and the piezoelectric film 2 is decreased. Accordingly, by appropriately designing the tag housing 8 to have a predetermined rigidity, the degree of mechanical coupling between forces applied to the outside of the tag housing 8 and the piezoelectric film 2, and therefore, the sensitivity of the tag 1 are affected. The mechanical design principles for determining the rigidity of a tag 1 (i.e., adjusting tag housing 8 shape and wall thickness) are well known, and therefore, need not be described further herein.

The manner in which the piezoelectric film 2 is affixed to the tag housing 8 also has an affect on the sensitivity of the tag 1. For example, the more rigidly the piezoelectric film 2 is affixed to the bottom wall 8A of the tag housing 8, the greater the degree of the mechanical coupling between forces applied to the outside of the tag housing 8 and the piezoelectric film 2, and therefore, the greater the sensitivity of the tag 1.

As can be appreciated from the above, by selecting the voltage reference Vr and the degree of mechanical coupling, the sensitivity of the tag 1 can be appropriately selected so that the tag 1 initiates an alarm for applied forces, which are less than those required to compromise the integrity of (e.g, crush, crack, open, etc.) the tag housing 8. In this way, the tag 1 is responsive to all types of attempts to tamper with the tag housing 8.

The sensitivity of the tag to unauthorized attempts to disengage the retaining tack 7 from the tack clip 6, or to cut the retaining tack 7, is affected by the degree of the mechanical coupling between the applied forces to the tack 7 and the piezoelectric film 2. Increasing the mechanical coupling increases the sensitivity of the tag 1. Illustrative factors which affect the mechanical coupling of the applied forces to the tack and the piezoelectric film 2 are: the position of the retaining tack 7 relative to the piezoelectric film 2, the thickness and rigidity of the retaining tack 7, the length of the retaining tack 7, the method of connecting the retaining tack 7 to the tag housing 8, and the physical characteristics of the tag housing 8. The mechanical design principles associated with the above indicated factors are well known, and therefore, they nee not be described further herein.

As can be appreciated, the sensitivity of the tag 1 can be appropriately selected so that the tag 1 initiates an alarm when a force applied to the tag housing 8, the retaining tack 7 or tack clip 6, is less than the force required to disengage the locking mechanism (i.e, cut the retaining tack or destroy the locking mechanism of the retaining tack). In this way, the tag is responsive to unauthorized attempts to disengage the locking mechanism of the tag 1.

Figure 4:
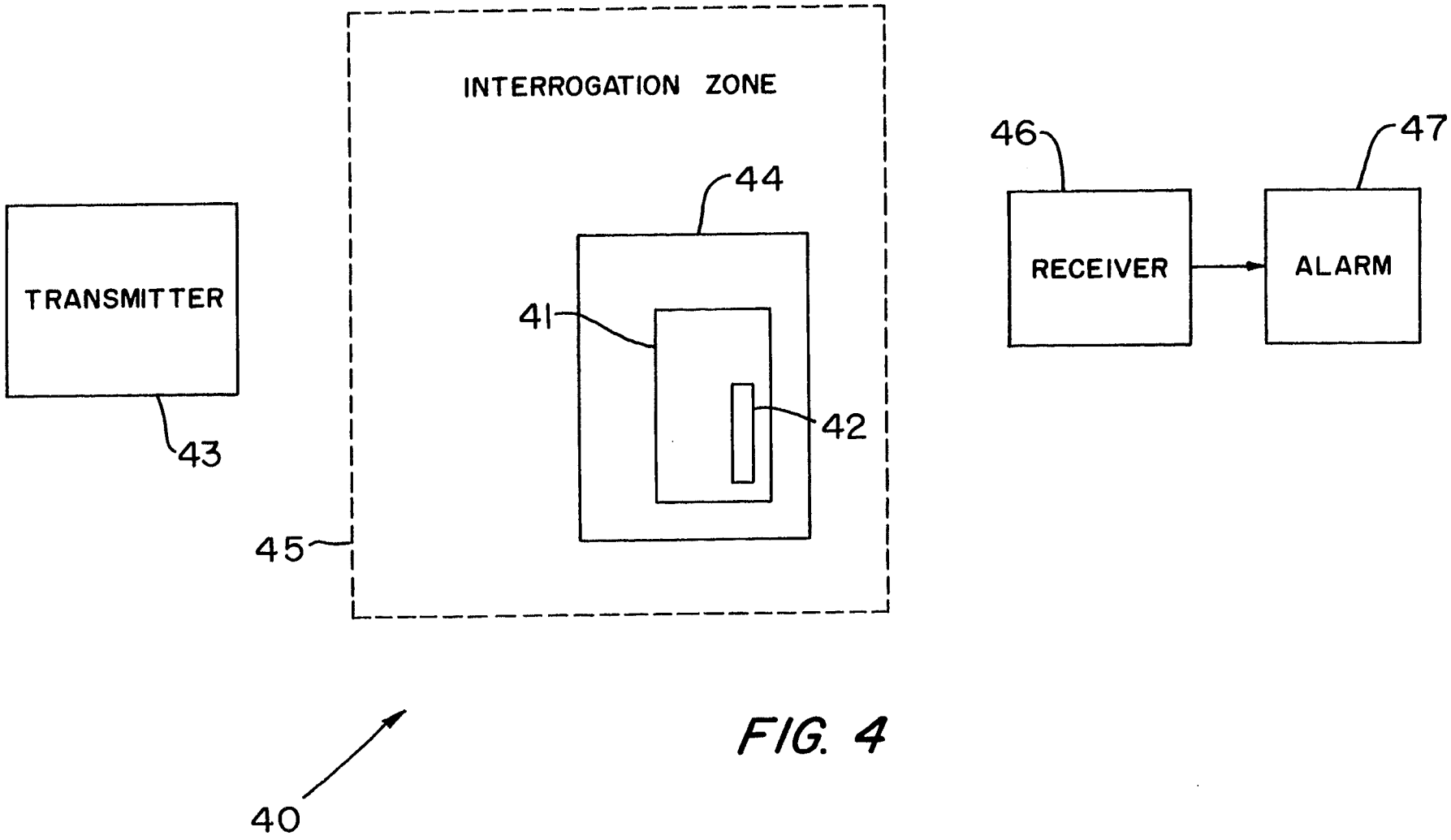
FIG. 4 shows an electronic article surveillance system using a tag in accordance with the principles of the present invention.

FIG. 4 illustrates an electronic article surveillance system 40 in accordance with the principles of the present invention. Tag 41 is in all respects the same as tag 1, previously described, except that tag 41 further comprises a detectable label, shown as a magnetic label detection component 42 housed inside the tag.

The electronic surveillance system 40 detects the presence of the label 42, the tag 41 and the attached article 44 in an interrogation zone 45. More particularly, the label 42 contained within the housing of the tag causes a signal to be generated in response to a transmitted signal from a transmitter 43. In the case of a magnetic label, the transmitted signal is magnetic field and the generated signal perturbations to the transmitted field. The generated signal is then detected by a receiver 46 and, upon such detection, an alarm 47 is sounded to indicate the presence of the tag 41 in the interrogation zone 45.

While FIG. 4 illustrates a magnetic type surveillance system for detecting a tag 41 having a magnetic label detection component 42 housed therein, it is understood that in accordance with the principles of the present invention, the tag can be easily modified to house other types of detectable labels. For example, the tag can be modified to house an RF label of the type disclosed in U.S. Pat. No. 4,686,513, and the surveillance system changed accordingly. Also, the tag might house a microwave label of the type disclosed in U.S. Pat. No. 4,063,229 and the surveillance system changed accordingly.

In the case of the embodiment shown with reference to FIG. 3, the voltage output V from the piezoelectric film 2 was used to initiate the alarm. However, as an alternative, it is known that the resistance of the piezoelectric film 2 changes as a function of the stress applied thereto. Accordingly, the embodiment of FIG. 3 can be easily changed to detect the resistance of the piezoelectric film 2, and to initiate the alarm upon detecting that the resistance has reached a predetermined threshold resistance value. Further, any other characteristics of the piezoelectric film 2, which change as a function of the stress applied thereto, can be sensed and used to trigger the alarm.

In the case of the embodiment shown in FIG. 3, a piezo bender 4 is used for generating the alarm signal and is located within the tag 1. However, in accordance with the principles of the present invention, different types of devices can be used for alarm indication. Further, the alarm device need not be located within the tag 1, but instead, can be remotely located and controlled from the tag 1.

It should also be noted that the tag 1 has been illustrated in FIG. 1 with the tag clip 6 including a locking mechanism and the retaining tack 7 attached to the tag body 8. Alternatively, the tag 1 can be constructed with the locking mechanism included in or on the tag body 8 and the tag retaining tack 7 attached to the tack clip 6.

In all cases it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. An antitheft tag for use in an electronic article surveillance system, comprising:

tag housing means;

piezoelectric means attached to said tag housing means in a way such that a force applied to said tag housing means is mechanically coupled to said piezoelectric means, said piezoelectric means generating an electrical signal in response to said mechanically coupled force and comprising a piezoelectric film; and alarm detection means for generating an alarm indication in response to said electrical signal generated by said piezoelectric means.

2. A tag in accordance with claim 1, further comprising:

locking means for removably attaching said tag housing means to an article to be monitored, said locking means being attached to said housing means in such a way that a force applied to said locking means is mechanically coupled to said piezoelectric means.

3. A tag in accordance with claim 2, wherein:

said piezoelectric means generates a voltage which is proportional to said force mechanically coupled to said piezoelectric means.

4. A tag in accordance with claim 3, wherein:

said alarm detection means comprises voltage comparing means for comparing the voltage generated by said piezoelectric means with a predetermined reference voltage.

5. A tag in accordance with claim 4, wherein:

said alarm detection means further comprises alarm indicating means responsive to said output of said comparing means to initiate an indication of an alarm.

6. A tag in accordance with claim 5 wherein:

said alarm indicating means is further responsive to an output of an alarm resetting means to remove the indication of the alarm.

7. A tag in accordance with claim 6 wherein:

said alarm indicating means comprises a piezo sounder, said piezo sounder being mounted internal to said tag housing means.

8. A tag in accordance with claim 7 further comprising:

a battery for supplying power to said alarm detection means.

9. A tag in accordance with claim 1 wherein:

said piezoelectric means is located inside said tag housing means.

10. A tag in accordance with claim 9, wherein:

said alarm detection means is located inside said tag housing means.

11. A tag in accordance with claim 1 wherein:

said tag housing means comprises a plastic enclosure having a flat bottom surface, said piezoelectric means being mechanically attached to an inner surface of said flat bottom surface.

12. A tag in accordance with claim 1, wherein:

said piezoelectric means exhibits a resistance change which is proportional to said force mechanically coupled to said piezoelectric means; and said alarm detection means is responsive to said resistance change to generate said alarm indication.

13. A tag in accordance with claim 1 wherein:

said tag further comprises a label housed within said tag housing means.

14. A tag in accordance with claim 13, wherein:

said label is a magnetic label.

15. A tag in accordance with claim 13, wherein:

said label is one of an RF label and a microwave label.

16. An antitheft tag for use in an electronic article surveillance system, comprising:

tag housing means;

piezoelectric means attached to said tag housing means in a way such that a force applied to said tag housing means is mechanically coupled to said piezoelectric means, said piezoelectric means generating an electrical signal in response to said mechanically coupled force;

alarm detection means for generating an alarm indication in response to said electrical signal generated by said piezoelectric means;

locking means for removably attaching said tag housing means to an article to be monitored, said locking means being attached to said housing means in such a way that a force applied to said locking means is mechanically coupled to said piezoelectric means; and said locking means comprises a retaining tack, a tack clip and locking member, said retaining tack being mechanically affixed to one of said tag housing means and said tack clip and said locking member attached to one of said tack slip and said tag housing means and said retaining tack being removably retained by said locking member.

17. An electronic article surveillance system comprising:

means for detecting the presence of an antitheft tag within an interrogation zone;

an antitheft tag comprising:

tag housing means;

piezoelectric means attached to said tag housing means in a way such that a force applied to said tag housing means is mechanically coupled to said piezoelectric means, said piezoelectric means generating an electrical signal in response to said force and comprising a piezoelectric film; and alarm detection means for generating an alarm indication in response to said electrical signal generated by said piezoelectric means.

18. A system in accordance with claim 17 wherein:

said tag further comprises: locking means for removably attaching said tag housing means to an article to be monitored, said locking means being attached to said housing means in such a way that a force applied to said locking means is mechanically coupled to said piezoelectric means.

19. A system in accordance with claim 18, wherein:

said piezoelectric means generates a voltage which is proportional to said force mechanically coupled to said piezoelectric means.

20. A system in accordance with claim 17 wherein:

said piezoelectric means is located inside said tag housing means.

21. A tag in accordance with claim 20 wherein:

said alarm detection means is located inside said tag housing means.

22. A system in accordance with claim 17 wherein: said tag further comprises: a label housed within said tag housing means.

23. A system in accordance with claim 22 wherein: said label is one of a magnetic label, an RF label and a microwave label.

24. A system in accordance with claim 23 wherein: said means for detecting the presence of said tag comprises: transmitting means for transmitting a signal into said interrogation zone, wherein said label causes a signal to be generated in response to said transmitted signal and receiving means for receiving said generated signal and generating an alarm.

* * * * *

UNITED STATES PATENT AND TRADEMARK OFFICE

CERTIFICATE OF CORRECTION

PATENT NO. : 5,367,289

DATED : November 22, 1994

INVENTOR(S) : Anthony Baro et al.

It is certified that error appears in the above-identified patent and that said Letters Patent is hereby corrected as shown below:

Col. 3, line 16. After "to" insert -- the --.

Col. 8, line 36. Change "slip" to -- clip --.

Signed and Sealed this

Fourteenth Day of February, 1995

*Attest:*

Bruce Lehman

BRUCE LEHMAN

*Attesting Officer*

*Commissioner of Patents and Trademarks*